United States Patent [19]

Guth

[11] Patent Number: 4,915,338

[45] Date of Patent: Apr. 10, 1990

[54] WALL SHELF SYSTEM

[75] Inventor: David C. Guth, Salt Lake City, Utah

[73] Assignee: Futura Industries Corporation, Boise, Id.

[21] Appl. No.: 347,077

[22] Filed: May 3, 1989

[51] Int. Cl.[4] ..... A47G 29/02

[52] U.S. Cl. ..... 248/250; 211/90

[58] Field of Search ..... 248/243, 250, 241, 242, 248/235; 108/108, 152; 211/90, 134

[56] References Cited

U.S. PATENT DOCUMENTS

| | | | |
|---|---|---|---|
| 3,471,111 | 10/1969 | McDonald | 248/250 |
| 4,037,813 | 7/1977 | Loui | 248/250 |
| 4,385,565 | 5/1983 | Roberts et al. | 108/152 |
| 4,508,301 | 4/1985 | Nicholson et al. | 211/90 X |
| 4,691,887 | 9/1987 | Bessinger | 108/108 X |
| 4,733,843 | 3/1988 | Bessinger | 248/250 |
| 4,736,918 | 4/1988 | Bessinger | 248/250 |
| 4,736,919 | 4/1988 | Bessinger | 108/152 X |
| 4,736,997 | 4/1988 | Besore et al. | 108/108 X |
| 4,738,426 | 4/1988 | Bessinger | 108/152 X |
| 4,752,010 | 6/1988 | Holztrager | 211/90 |
| 4,765,575 | 8/1988 | Bergl | 248/250 |

*Primary Examiner*—J. Franklin Foss

*Attorney, Agent, or Firm*—Frank J. Dykas; Craig M. Korfanta

[57] ABSTRACT

A wall shelf system having elongated support bracket 11 formed as a single unit with vertical back panel 20, a forwardly extending upper support member 13 and a forwardly extending lower support member 12, which together with the back panel form an elongated slot for receiving glass shelf 22. Lower support member 12 is provided with three distinct surfaces, the forwardmost of which is lower support surface 17, a rearwardly downwardly extending insert ramp 16, and lock strip 15 located at the rearmost portion of the slot. Glass shelf 22 together with attached snap locks 23 is inserted into the slot where the lower legs of snap locks 23 snap interfit within snap lock notch 15 to lock glass shelf 22 in place.

7 Claims, 2 Drawing Sheets

WALL SHELF SYSTEM

BACKGROUND OF THE INVENTION

1. Technical Field

This invention generally relates to a wall shelf system. More particularly, to an elongated wall shelf support bracket which is attached to a vertical surface and supports, in cantilevered fashion, a glass or other non-ligneous material wall shelf.

2. Background Art

Cantilevered wall shelves have become increasingly popular over the years as a substitute for more expensive and space consuming bookcase or shelf furniture. The early applications of cantilevered wall shelves utilized some variation of a peg boards or vertical wall standards and brackets to fully support the entire width of a wood shelf. These wall support systems had obvious utilitarian value, however they were not particularly attractive in appearance and design, and as a result were a poor substitute for bookshelves and other types of shelving furniture for ruse in the living areas of a home or apartment.

Ornamental wall shelves in common usage today are cantilevered and incorporate a design feature wherein the screws used to attach the bracket to the wall are concealed behind the shelf or under a closeable facing. Typically an elongated slot is formed in the wall bracket for receiving the wall shelf. The general design problems which the prior art attempt to overcome are twofold. The first is to firmly hold the shelf in cantilevered fashion so that it does not wobble, and secondly, to fasten the rear portion of the shelf to the wall brackets so that it cannot be inadvertently or accidentally dislodged by contact or intentionally pulled from its bracket as, for example, by a young child.

Typical of such early attempts are MacDONALD, U.S. Pat. Nos. 3,471,111 and 3,471,112, which feature a lower support bracket insertable into a hole drilled into a wall surface. The MacDonald brackets contemplate the use of at least two brackets to support any particular shelf. The problem is that the shelf support brackets are difficult to fasten to a wall, and more adapted for use against a wood surface as opposed to a drywall, plaster or sheetrock wall surface.

LOUI, ET AL., U.S. Pat. No. 4,037,813, represents an improvement over the MacDonald shelf support brackets in that means are provided to frictionally engage a resilient shelf to hold it in a wedged, cantilevered position. In the embodiment suitable for use with a glass shelf, this wedging cantilivered system requires the application of downward forces on the elongated shelf at the point where it is supported by the lower support surface, to cause it to pivotally force the rear edge of the shelf up against an upper support surface to hold the cantilevered shelf in position. The problem with Loui, et al. is providing a means to hold the shelf in the bracket in a manner such that it cannot be easily and accidentally removed either by someone brushing up against the shelf, or a child attempting to pull it out from the wall.

ROBERTS, ET AL., U.S. Pat. No. 4,385,565, attempts to solve the problem of inadvertent removal of the shelf from the support bracket by use of an inwardly inclined retaining ridge for gripping or digging into the shelf in the event that someone attempts to remove it. However the Roberts shelf support is not suitable for use with a glass or other non-ligneous material shelf, in that the retaining ridge would not grip against the glass surface, and the glass shelf would wobble. As a result, Roberts teaches a second embodiment without the retaining ridge for use with a glass shelf. But again, no provision is made to prevent its accidental removal. NICHOLSON, ET AL., U.S. Pat. No. 4,508,301 is another variation of the inventive concepts disclosed in Roberts, et al. Again, it requires the use of ligneous material for the shelves to provide the resiliency to allow effective use of the system to hold the shelf in the bracket.

BESSINGER, U.S. Pat. No. 4,691,887 is a first attempt at providing a retentive shelf anchor for a glass wall shelf. It incorporates the use of a resilient polymeric insert having elongated flexible fingers extending downwardly and rearwardly to provide a retention force to the top of a glass wall shelf. While Bessinger, U.S. Pat. No. 4,691,887 represents an improvement over the prior art in that it does provide some retention forces for a glass shelf, it suffers from a number of drawbacks, not the least of which is the fact that the glass shelf can still be easily and accidentally removed from the bracket. Additionally, it requires the installation of a resilient insert into an elongated slot in the wall shelf bracket. This can be difficult in cases where the elongated bracket is of some substantial length itself.

As a result, there have been additional attempts to provide a secure retentive anchoring system for glass wall shelves. BESSINGER, U.S. Pat. Nos. 4,733,843, 4,736,918 and 4,736,919 teach three additional designs for anchoring a glass wall shelf to a support bracket. In Bessinger U.S. Pat. No. 4,733,843 the shelf bracket is provided with a pair of lower support members, the innermost one of which is brought into compressive engagement with the glass shelf by means of a set screw. This is a complicated design, and a relatively expensive product to manufacture. In Bessinger U.S. Pat. No. 4,736,918 another design is disclosed which teaches the use of a concealed set screw which is inserted through a preformed hole in the glass shelf. And finally, Bessinger, U.S. Pat. No. 4,736,919 provides for a shelf bracket where a set screw engaged in a fixed traveler nut is used to bear directly against the glass shelf. In all these cases it is possible to impose excessive compressive forces upon the glass shelf thereby causing it to fracture and break.

HOLZTRAGER, U.S. Pat. No. 4,752,010 teaches a display wall system which utilizes plastic or possibly glass wall shelving held in cantilevered fashion by means of upper and lower double sided tapes which attach the shelf to opposing upper and lower shelf support brackets. It is not a suitable design for a single shelf residential unit.

Accordingly, what is needed is a wall shelf system which provides a shelf bracket for use with a glass shelf, wherein once the glass shelf has been inserted into the bracket it can no longer be removed therefrom except by means of a determined pull, and which does not utilize set screws which can impart excessive compressive forces to the shelf, thereby causing it to fracture and break. A second object is to provide a wall shelf bracket which is of simple design and amenable to fabrication by simple die extrusion processes. A final object is a fabrication of the wall shelf system which is attractive and pleasing to the eye.

DISCLOSURE OF INVENTION

These objects are accomplished by use of a wall shelf system having an elongated support bracket formed as a unitary piece with a vertical back panel wall, a forwardly extending upper support member and a forwardly extending lower support member which, together with the back panel, form an elongated slot for receiving a glass shelf. The lower support member is provided with three distinct surfaces, the forwardmost of which is a lower support surface, an intermediate, rearwardly and downwardly extending insert ramp, and an inner lock strip notch at the rearmost portion of the elongated slot.

A plurality of resilient V-shaped snap locks are provided for attachment to the underside of the glass shelf at the rearmost edge. The V-shaped snap locks are formed of resilient material and are attached with their vertexes at the rear edge of the shelf, with one of the legs of the V angling forward and downward to form a snap plate. The V-shaped snap locks are attached to the glass shelf with pressure sensitive tape.

The wall bracket is held in position against the vertical wall surface by means of screws inserted through screw holes formed in the back panel at the back of the elongated slot. Upper and lower wall grip surfaces are provided for compressive engagement with the wall to firmly hold the bracket in place.

Once the bracket is installed, the glass shelf, with attached snap locks, is inserted into the slot a sufficient distance to allow the lower legs, or snap plates, of the V-shaped snap locks to snap interfit into the lock strip notches, thereby locking the shelf in position.

BEST MODE FOR CARRYING OUT INVENTION

Figure 2:
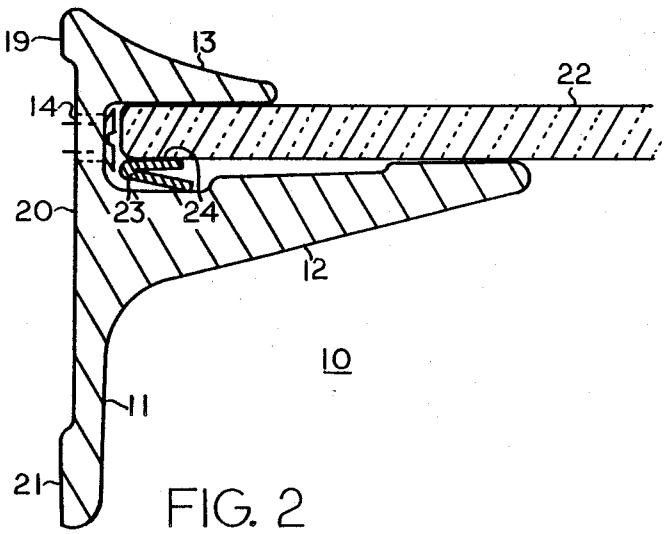
FIG. 2 is a sectional side view of the wall bracket with the glass shelf inserted.
Figure 1:
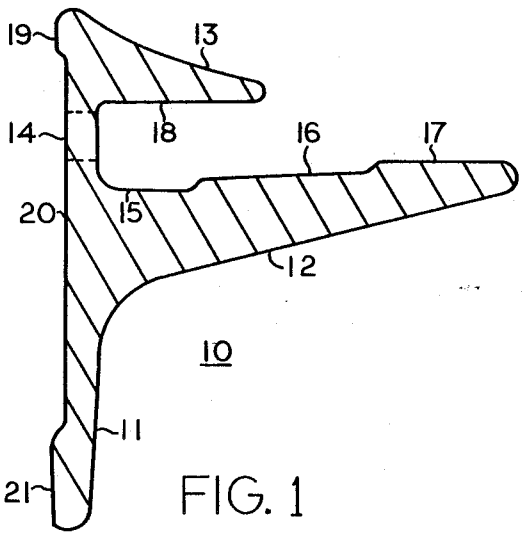
FIG. 1 is a sectional side view of the elongated wall bracket.
Figure 3:
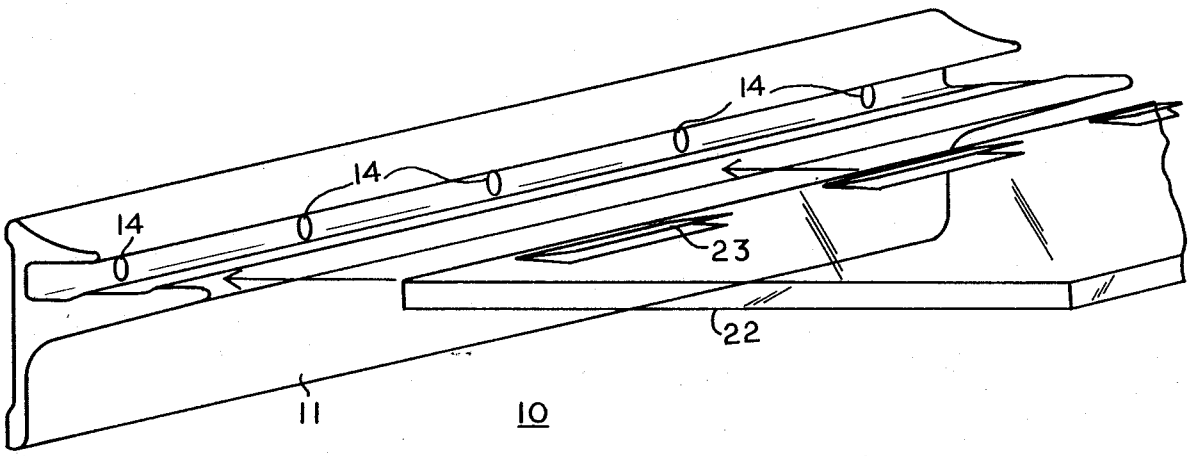
FIG. 3 is an exploded perspective representational view of the wall shelf system.

Referring to FIGS. 1, 2 and 3, the wall shelf support system, generally identified as 10, is shown to utilize elongated wall bracket 11, a plurality of snap locks 23, and wall shelf 22. Elongated wall bracket 11 is an extruded unitary piece to which only two additional machining steps need be performed to fabricate a finished product, namely, the punching or stamping of screw holes 14 into the vertical panel at the back of the elongated. slot, and the anodizing and/or painting of the bracket.

Elongated wall bracket 11 if formed of back panel 20, upper support extension 13 and lower support extension 12, which together form an elongated slot for receiving glass shelf 22. Formed integral with lower support extension 12 are three distinct surfaces, the forwardmost of which is lower bearing surface 17 which supports glass shelf 22, and when glass shelf 22 is weighted, pivotally forces the upper surface of glass shelf 22 up against upper support extension 13 to provide a cantilevered support for glass shelf 22. Lock strip notch 15 is provided at the rearwardmost portion of lower support extension 12 for receiving the downwardly and forwardly extending legs or snap plates of V-shaped snap locks 23 when glass shelf 22 is inserted into wall bracket 11.

To provide room for said insertion of glass shelf 22 and snap locks 23, insert ramp 16 is provided between lower bearing surface 17 and lock strip notch 15 to allow space for the insertion of glass shelf 22 and attached V-shaped snap locks 23. The use of insert ramp 16 allows for the vertical spacing between upper bearing surface 18 and lower bearing surface 17 to closely conform to the thickness of glass shelf 22 thereby providing for horizontal orientation of the shelf after it has been inserted. Without insert ramp 16 the vertical distance between upper bearing surface 18 and lower bearing 17 would have to be increased to accommodate the excess thickness of the rearmost portion of glass shelf 22 with its attached plurality of snap locks 23. This would result in a shelf, after insertion, that would wobble up and down and which would be canted downward at a noticeable angle when weighted.

In the preferred embodiment snap locks 23 are fabricated of polypropylene and are provided with pressure sensitive tape on the upper leg of each V-shaped snap lock for purposes of attaching said snap locks to glass shelf 22.

It is contemplated that the shelf support system 10 will be commonly used for attachment to drywall, plaster and sheet rock vertical wall surfaces. These wall surfaces have some plasticity to them, and as a result upper and lower rear grip surfaces 19 and 21 are provided for additional positive compressive frictional engagement with the wall surface. When screws, not shown, are inserted through holes 14 when the bracket is being attached to the wall, upper and lower grip surfaces 19 and 21 are forced firmly into compressive engagement with the wall surface. As the screws are tightened, the back panel of the bracket bows inward an imperceptible amount, but sufficient to hold the shelf bracket in firm contact with the wall in a manner wherein it is able to remain in firm contact even under situations where the wall or bracket is bumped or vibrated.

To assemble the wall shelf, the installer first positions and attaches the support bracket 11 to the wall. Then snap locks 23 are attached to shelf 22, which in turn is inserted into the elongated slot in bracket 11. The lower legs of V-shaped snap locks 23 will automatically interfit within lock strip notch 15 thereby locking shelf 22 firmly in place. Only a determined pull on shelf 22 will cause snap locks 23 to yield and allow shelf 22 to be removed from bracket 11.

While there is shown and described the present preferred embodiment of the invention, it is to be distinctly understood that this invention is not limited thereto but may be variously embodied to practice within the scope of the following claims.

I claim:

1. A wall shelf system which comprises:

an elongated support bracket having an elongated vertical back panel for attachment to a vertical surface, an upper support member and a lower support member formed integral with said vertical panel and forwardly extending horizontally out therefrom, to form, together with a portion of the back panel, an elongated slot for receiving and supporting in cantilevered fashion substantially all of the rearward portion of an elongated wall shelf, said vertical back panel further having a plurality of screw holes interspace along the portion of said vertical back panel which forms the back of the elongated slot;

said lower support member further having an elongated lock strip notch formed integral therewith along the length of the rear section of the upper surface of said lower support member for receiving the downwardly extending snap plate of a resilient snap lock strip;

an elongated wall shelf having a rearward portion adapted for insertion into the elongated slot formed between the upper support member, back panel and the lower support member of the bracket; and a plurality of resiliently polypropylene V-shaped snap lock strips being adhesively attached along the length of the rearward portion of the elongated wall shelf with their vertexes pointing rearwardly and having forwardly and downwardly extending snap plates for snap interfitting within the lock strip notch.

2. The wall shelf support system of claim 1 wherein said elongated wall shelf is formed of non-ligneous material.

3. The wall shelf system of claim 1 wherein said lower support member further comprises:

a horizontal lower bearing surface strip formed along the forwardmost portion of the said lower support member for supporting the underside of the elongated shelf; and an insert ramp formed between and connecting the lower bearing support surface and the lock strip notch, said insert ramp extending generally downwardly and rearwardly from the forward lower bearing support surface to the lock strip notch.

4. The wall shelf support system of claim 3 wherein said elongated wall shelf is formed of nonligneous material.

5. The wall shelf support system of claim 1 wherein said vertical back panel further comprises:

a upper wall grip surface formed along the length of the upper surface of said elongated vertical back panel for compressive frictional engagement with the vertical surface; and a lower grip surface formed along the lower edge of said back panel for compressive frictional engagement with a vertical surface.

6. The wall shelf support system of claim 3 wherein said vertical back panel further comprises:

an upper wall grip surface formed along the length of the upper surface of said elongated vertical back panel for compressive frictional engagement with the vertical surface; and a lower grip surface formed along the lower edge of said back panel for compressive frictional engagement with a vertical surface.

7. A wall shelf system which comprises:

an elongated support bracket having an elongated vertical back panel for attachment to a vertical surface, an upper support member and a lower support member formed integral with said vertical panel and forwardly extending horizontally out therefrom to form, together with a portion of the back panel, an elongated slot for receiving and supporting in cantilevered fashion substantially all of the rearward portion of an elongated wall shelf, said vertical back panel further having a plurality of screw holes interspaced along the portion of said vertical back panel which forms the back of the elongated slot;

said lower support member further having an elongated lock strip notch formed integral therewith along the length of the rear section of the upper surface of said lower support member for receiving the downwardly extending snap plate of a resilient snap lock strip;

an elongated wall shelf of non-ligneous material having a rearward portion adapted for insertion into the elongated slot formed between the upper support member, back panel and the lower support member of the bracket;

a plurality of resilient polypropylene V-shaped snap lock strips being adhesively attached along the length of the rearward portion of the elongated wall shelf with their vertexes pointing rearwardly and having forwardly and downwardly extending snap plates for snap interfitting within the lock strip notch;

a horizontal lower bearing surface strip formed along the forward portion of the lower support member for supporting the underside of the elongated shelf;

an insert ramp formed between and connecting the lower bearing support surface and the lock strip notch, said insert ramp extending generally downwardly and rearwardly from the forward lower bearing support surface to the lock strip notch;

an upper wall grip surface formed along the length of the upper surface of said elongated vertical back panel for compressive frictional engagement with the vertical surface; and a lower grip surface formed along the lower edge of said back panel for compressive frictional engagement with a vertical surface.

* * * * *